US005507573A

United States Patent [19]

Hiorth

[11] Patent Number: 5,507,573

[45] Date of Patent: Apr. 16, 1996

[54] METHOD AND A MEANS FOR CONTINUOUS, STATIC MIXING OF THIN LAYERS

[76] Inventor: Hans Hiorth, Konglestien 8, 3400 Lier, Norway

[21] Appl. No.: 129,113

[22] PCT Filed: Apr. 3, 1992

[86] PCT No.: PCT/NO92/00064

§ 371 Date: Nov. 19, 1993

§ 102(e) Date: Nov. 19, 1993

[87] PCT Pub. No.: WO92/17271

PCT Pub. Date: Oct. 15, 1992

[30] Foreign Application Priority Data

Apr. 5, 1991 [NO] Norway ..... 911337

[51] Int. Cl.[6] ..... B01F 5/24

[52] U.S. Cl. ..... 366/137.1; 366/178.1; 239/417.3; 239/424

[58] Field of Search ..... 366/2, 142, 160, 366/162, 167, 173, 174, 176, 178, 336, 337, 341, 348, 137.1, 178.1; 239/416.5, 417.3, 424, 457

[56] References Cited

U.S. PATENT DOCUMENTS

| | | | |
|---|---|---|---|
| 969,978 | 9/1910 | Phillips | 239/417.3 |
| 1,713,260 | 5/1929 | Chandler | 239/424 X |
| 1,921,059 | 8/1933 | Weil et al. | 239/416.5 |
| 2,236,551 | 4/1941 | Striegel | 239/424 X |
| 4,191,480 | 3/1980 | Hiorth . | |
| 4,323,314 | 4/1982 | Kaiser-Wirz . | |
| 4,573,801 | 3/1986 | Leschonski et al. . | |
| 4,662,759 | 5/1987 | Leibee et al. | 366/178 X |

FOREIGN PATENT DOCUMENTS

| | | |
|---|---|---|
| 135398 | 4/1977 | Denmark . |
| 1181952 | 6/1959 | France . |
| 2041230 | 6/1982 | Germany . |
| 140968 | 9/1979 | Norway . |
| 427328 | 3/1983 | Sweden . |

*Primary Examiner*—Charles E. Cooley
*Attorney, Agent, or Firm*—Wenderoth, Lind & Ponack

[57] ABSTRACT

A method and apparatus for controlling the volume or quantity of components being fed into a continuous, static mixing head are based upon the phenomenon of concentric, thin layers meeting with high velocities in a circular and free-flowing mixing zone (14). The regulating method can be adapted to various embodiments of mixing heads, and can be used for raw material combinations comprising powders, liquids, gas vapor or air, as well as mixing a small quantity into a large quantity. The thin layers are formed and controlled in conical, annular nozzles between fixed cone surfaces (12, 25, 27) and axially movable cone surfaces (11, 28, 29), where the movements are transferred from displacement members (15, 34) on the outside of the mixing head which regulate nozzle orifices and amounts or volumes. One situation regulates a mixing head where a downward directed powder layer in the mixing zone meets with obliquely downward directed liquid layers from the inside and the outside. In the mixing zone, mixing and discharge occurs instantaneously. A mixing process for cement related products uses three mixing heads connected in series, with different products after each respective steps. The mixing heads are compact. Capacities of up to 150 $m^3$/hour can be achieved with a mixing zone diameter smaller than 200 mm.

17 Claims, 1 Drawing Sheet

METHOD AND A MEANS FOR CONTINUOUS, STATIC MIXING OF THIN LAYERS

BACKGROUND OF THE INVENTION

The present invention relates to a method and apparatus for controlling the amounts (quantities; volumes; proportions) of components being fed into a continuous, static mixer of the thin layer type. The apparatus directly controls a slit of annular nozzles which convert the component flows into thin layers in a mixing apparatus, so as to be able to control the layer thicknesses and hence the through-put quantity.

Continuous static mixing is generally characterized by components being fed continuously and at a high speed into a mixing apparatus without moving parts, where only the kinetic energy is used for mixing. This is in contrast to a batch mixing process with charge feeding, and where mixing is effected by means of agitators or overturning the compound.

Today, mixing processes are part of almost all process industry. In order to save energy, investments, labor, etc. there is an increasing tendency to avoid batch mixing and turn to a continuous mixing procedure. The present method and control apparatus increases the range of use for thin layer mixing, so that this mixing system will be used increasingly with raw material combinations like: powder/powder, powder/liquid, liquid/liquid and powder or liquid/gas, vapour or air and in special cases: large quantity/small quantity.

In continuous, static thin layer mixing, the mixing process takes place inside a mixing head, where preferably a fluidized powder component or suspension is fed in axially from above, and where a liquid or gas component has a radial inlet. The raw materials are subjected to a moderate excess pressure before being led through off/on valves into the mixing head nozzles, where static pressure is converted to kinetic energy. Thin layers are formed by the axial component out flow of the nozzle when the flow is spread out on an underlying cone surface while thin layers of the radially introduced component are formed in annular nozzles. When the thin layers meet in a freely flowing circular mixing zone, an instantaneous mixing effect is achieved with an instantaneous further transport of the mixed product out of the mixing zone. The best mixing result is achieved in a mixing zone where a downwards directed layer of axially introduced raw material meets one layer from the outside and one layer from the inside, both containing the radially introduced raw material. This means that the radial raw material flow is distributed to an annular nozzle on the outside and an annular nozzle on the inside of the mixing zone.

So far, the thin layer mixing method has not gained any substantial ground. This is due to the fact that this method has not included an effective method and apparatus for adjusting the amount of raw material before the mixing process is started, nor a possibility of being able to adjust the quantities during mixing. With normal pressure/quantity control valves in front of the mixing head, it will certainly be possible to regulate the quantities. However, the exit velocity from the nozzles will then be different with an unchanged nozzle cross section. Besides, the available pressure convertible to velocity in the nozzle will be reduced in the valve system.

SUMMARY OF THE INVENTION

In the present invention, quantity control takes place in the annular nozzles in such a manner that the exit velocity is maintained approximately constant even if the through-put amount is regulated. In accordance with the construction, quantities are regulated by means of movable nozzle surfaces inside the mixing head, and by transferring the movements to operating elements on the outside of the mixing head. By pre-adjusting the operating elements, the proportions can be determined before start of the mixing process, and furthermore, adjustment can be executed during the mixing procedure.

Normally, each separate raw material supply will also be provided with its respective outside off/on valve. These valves will in this system preferably be used for starting and stopping the mixing process.

The above mentioned advantages of this quantity regulating method are achieved by the feature of the nozzles having one fixed and one coaxially movable cone surface. By axially displacing the movable cone surfaces in relation to the fixed ones by means of, e.g., threaded joints, the circular nozzle orifices are changed. The thickness of the layers flowing out, and hence the amounts, are thereby changed. This means that with a constant pressure drop through the nozzle and a constant exit velocity the mixing ratio can be regulated. With the threaded joint a certain angular setting will correspond to a certain nozzle orifice. It will be possible to read the associated quantity on scales on the outside of the mixing head.

For industrial use the quantity determination of the components is more difficult in a continuous process than in batch processes, where exact weighing is undertaken for each raw material. In a continuous mixing process there are continuous measuring methods for the raw materials before mixing, however these methods do not provide the desired accuracy and practical usefulness. Therefore, in the present mixing method direct control in accordance with the invention is an alternative or a supplement in a continuous mixing process. One regulating problem in other continuous mixing processes is a correct mixing ratio in the start and stop phases. In contrast, the present mixing and regulating method, comprising a short and approximately the same run-through time for the raw materials as well as instantaneous mixing, and which features are combined with pre-adjustment of the mixing ratio, provides correct mixing conditions also when starting and stopping.

BRIEF DESCRIPTION OF THE DRAWINGS

The method and control apparatus in accordance with the invention will be apparent from the drawings, which together with the description refer to a mixing head in two embodiments, particularly for the mixing of powder and liquid.

DETAILED DESCRIPTION OF THE PREFERRED EMBODIMENT

Figure 1:
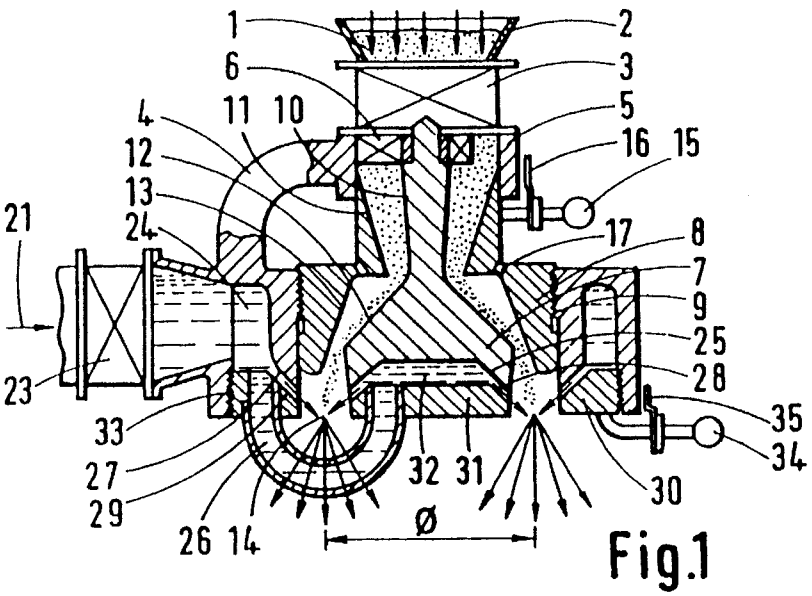
FIG. 1 shows a section through a mixing head with supply to an inner liquid nozzle through pipe ribs laid through an outflowing finished mixture.

FIG. 1 represents a view of an the lower part of exit funnel 2 in a pressure hopper containing fluidized powder 1, which lower part opens for axial powder introduction to the mixing head when an on/off valve 3 is opened. Correspondingly, an on/off valve 23 simultaneously opens for radial introduction of a liquid component 21, which is subject to a corresponding pressure.

The main part of the mixing head is a housing 4 with internal nozzles and distribution channels. The upper part 5 of the housing 4 has an inwardly directed, radial rib system 6 with a hold for a central nozzle member 7. Concentrically and externally thereto is an axially sliding control member 8. Members 7 and 8 constitute at the top a powder nozzle with a fixed cone surface 10 and an adjustable cone surface 11. Member 8 has on its outside a cylindrical upper surface in sliding engagement with the inner surface of a part 5. The outer lower surface of member 8 has external threads 9 in engagement with threads of the housing 4. The nozzle member 7 has a spreading surface 12 where the thin layer is formed. Quantity control takes place where the cone surface 11, by an axial displacement regulates layer thickness against the spreading surface 12, where the layer has its greatest thickness, so that lumps as large as possible may pass. A cone surface 13 has a clearance volume directed toward the powder layer, which provides a means of ventilating or introducing a third raw material by means of a hole 17 in the member 8. At the lower end of cone surface 12, where the powder layer has reached its smallest thickness, the layer is directed downwards when meeting with the cone surface 13 prior to entering a mixing zone 14.

A radially introduced amount of liquid 21 is led into the housing 4 and to an annular chamber 24, wherefrom half the amount exits through an inwardly directed annular nozzle with a fixed cone surface 27. The rest of the liquid passes from the annular chamber through a number of radially inwardly directed pipe ribs 26 to a central distribution chamber 32 with an outwardly directed annular nozzle with a fixed cone surface 25. The thin layers from the outer and inner annular nozzles hit the downwardly directed powder layer from both the outward and inward direction in the mixing zone 14. The pipe ribs 26 also connect member 30 to member 31, forming a slab where a rotation of threads 33 regulates the nozzle orifices in parallel between the fixed cone surfaces 25 and 27 and adjustable cone surfaces 28 and 29. The finished mixture from the mixing zone passes through the openings between the pipe ribs. The slab is rotated by means of a handle 34 with a pointer 35 against a fixed scale, which indicates layer thickness and quantity from given operation conditions. Correspondingly, the powder amount is controlled by means of a handle 15 with a pointer 16 againt corresponding scales. When operating by means of a remote control, cylinders, step motors or similar well known components are used.

Figure 2:
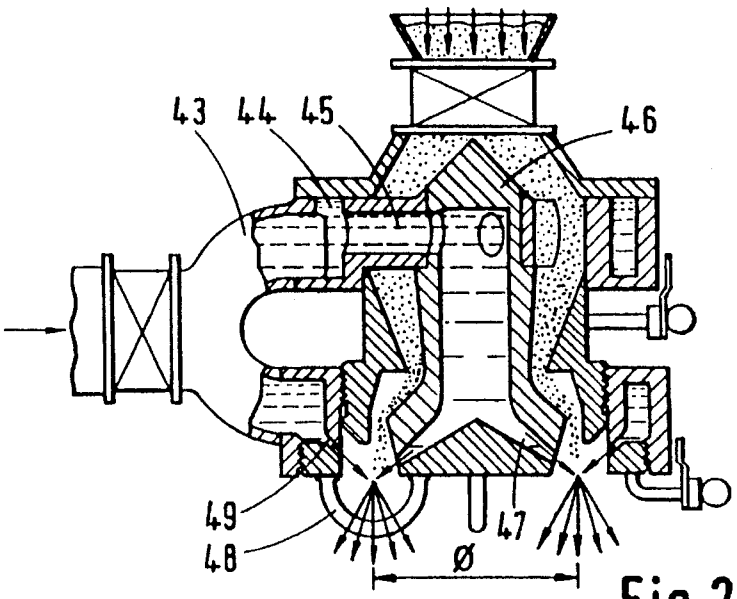
FIG. 2 shows a section through a mixing head with supply to an inner liquid nozzle through pipe ribs laid through inflowing powder.

In FIG. 2 a corresponding regulating scheme is shown for a mixing head for a sticky mix product. In this case the pipe ribs have been placed above the powder nozzles, and a rib system 48, which is as thin as possible, is used after the mixing zone. In this a manner larger exit openings are achieved for the mixed product, as well as an improved self-cleaning of the ribs.

The mixing head has a split inlet pipe 43, with half the liquid supply directed to an annular channel 44 and further on through pipe ribs 45 to a member 46, which has a central pipe connection to an inner annular nozzle 47. The rest of the amount of liquid introduced passes directly to an outer annular nozzle 49. Control of the powder amount and liquid amount is effected in the same manner as in FIG. 1, by varying the layer thicknesses between the fixed and the adjustable cone surfaces of the three nozzles.

Figure 3:
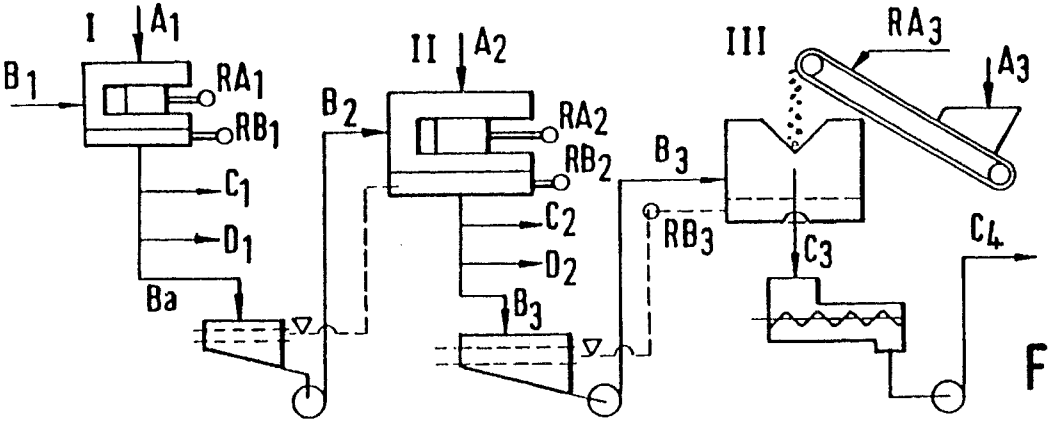
FIG. 3 schematically shows a mixing process comprising several mixing heads.

In FIG. 3 there is shown, in a schematic fashion, a process solution constructed of several mixing heads in a series configuration. A tangible example is a manufacturing process for cement related products, where each step actually delivers a ready-made product, but where this product also may enter successive steps as a raw material. For steps I, II and III the sketch shows associated mixing heads, where:

| | |
|---|---|
| A1 | indicates cement with optional additives. |
| B1 | indicates cement with optional additives. |
| C1, D1 and B2 | indicate cement slurry for respectively molding purposes in oil drilling, building and construction and as a raw material for step II. |
| A2 and A3 | indicate sand and gravel of various grading. |
| C2, D2 and B3 | indicate respectively plaster cement, spray concrete and a raw material for step III. |
| C3 | indicates pre-mixed concrete with C4 as finished concrete after additional mixing in, e.g., screw/pump equipment. |
| RA1, RB1–RA3, RB3 | indicate means for controlling or regulating of quantity. |

The shown intermediate containers, pressure pumps and pipe/hose transport means are optionally also included.

A method and regulating means following the same principles will also apply to special embodiments of mixing heads where more than two raw materials are introduced into the same mixing head. Such extra raw materials will preferably be based upon unilateral introduction into existing layers in order to not make the mixing head too complex.

Finally, some data from finished mixing heads with regulating means in accordance with the invention are presented.

The pressure range for incoming raw materials for powders and liquids is 1–3 Bar, which corresponds to thin layer velocities of 10–15 m/s. The thickness of the powder layer is 1–3 mm and the liquid layer 0.1–1 mm. The mixing head capacity will be a product of the velocity, layer thickness and mixing zone circumference. For a selected mixing zone diameter of about 30–200 mm, it is possible to obtain capacities in the range 5–150 $m^3$/hour.

I claim:

1. A method of controlling the amounts of components being mixed in a static mixing head, comprising the steps of:

forming thin coaxial layers of at least two components in coaxial annular nozzles, said coaxial annular nozzles each having a fixed inner conical surface and a movable outer conical surface forming respective nozzle orifices that are variable in size;

combining the thin coaxial layers formed in said coaxial annular nozzles in a common circular mixing zone; and varying the thickness of each of the thin layers and the amount of each of the components by varying the size of each respective nozzle orifice by operating a respective displacement mechanism that is located on the exterior of the static mixing head and connected with the respective movable outer conical surface by axially displacing the movable Outer conical surface relative to the fixed inner conical surface so as to control the respective nozzle orifice;

wherein said step of varying the thickness of each of the thin layers comprises operating a coaxial threaded joint to axially displace the movable outer conical surface relative to the fixed inner conical surface, the fixed inner conical surface being located on the static mixing head, the displacement mechanism comprising an operating member located on the static mixing head; and wherein said movable outer conical surfaces of at least two of the coaxial annular nozzles are interconnected by one of pipes and ribs, and wherein said step of combining further comprises passing a finished mixture of the components combined in the circular mixing zone between the one of pipes and ribs to exit the static mixing head.

2. The method of claim 1, wherein said step of varying comprises displacing the movable outer conical surfaces of the at least two of the coaxial nozzles together.

3. A method of controlling the amounts of components being mixed in a static mixing head, comprising the steps of:

forming thin coaxial layers of at least two components in coaxial annular nozzles, said coaxial annular nozzles each having a fixed inner conical surface and a movable outer conical surface forming respective nozzle orifices that are variable in size;

combining the thin coaxial layers formed in said coaxial annular nozzles in a common circular mixing zone; and varying the thickness of each of the thin layers and the amount of each of the components by varying the size of each respective nozzle orifice by operating a respective displacement mechanism that is located on the exterior of the static mixing head and connected with the respective movable outer conical surface by axially displacing the movable outer conical surface relative to the fixed inner conical surface so as to control the respective nozzle orifice; and wherein said movable outer conical surfaces of at least two of the coaxial annular nozzles are interconnected by one of pipes and ribs, and wherein said step of combining further comprises passing a finished mixture of the components combined in the circular mixing zone between the one of pipes and ribs to exit the static mixing head.

4. A static mixing head, comprising:

a mixing head housing;

a first annular nozzle in said housing, said first annular nozzle being connected to a first component inlet in said housing and having a first variable nozzle orifice;

a second annular nozzle in said housing, said second annular nozzle being coaxial with said first annular nozzle, connected to a second component inlet in said housing and having a second variable nozzle orifice; and a common circular mixing zone defined downstream of said first and second variable nozzle orifices;

wherein said first annular nozzle comprises a first adjustable member at least partially defining said first variable nozzle orifice, said first adjustable member being connected with a first displacement mechanism located on said mixing head housing for varying the size of said first variable nozzle orifice; and wherein said second annular nozzle comprises a second adjustable member at least partially defining said second variable nozzle orifice, said second adjustable member being connected with a second displacement mechanism located on said mixing head housing for varying the size of said second variable nozzle orifice.

5. The static mixing head of claim 4, wherein at least one of said first and second annular nozzles comprises a fixed annular cone surface and the respective said adjustable member of said at least one of said first and second annular nozzles comprises a movable outer cone surface that is movably mounted for movement along an axis of said mixing head housing for varying the size of the respective said variable nozzle orifice.

6. The static mixing head of claim 5, wherein said adjustable member comprising said movable outer cone surface has a coaxial threaded joint connecting said adjustable member to said mixing head housing.

7. The static mixing head of claim 5, and further comprising a third annular nozzle in said housing, said third annular nozzle being coaxial with said first and second annular nozzles and connected to a second component inlet in said housing and having a third variable nozzle orifice, said third annular nozzle comprising a third adjustable member at least partially defining said third variable nozzle orifice.

8. The static mixing head of claim 7, wherein said third adjustable member and said second adjustable member are connected together by rigid ribs located below said circular mixing zone such that said second displacement mechanism, connected to said second adjustable member, operates to displace said third adjustable member.

9. The static mixing head of claim 8, wherein said rigid ribs define component passages connecting said second fluid inlet to said third annular nozzle.

10. A static mixing head, comprising:

a mixing head housing having a first component inlet and a second component inlet therein;

a circular mixing zone;

a first annular nozzle in said housing fluidly connected with said first component inlet, said first annular nozzle having a nozzle orifice defined by said housing and a first adjustable member movably mounted relative to said housing, and said first annular nozzle being directed toward said circular mixing zone;

a second annular nozzle in said housing fluidly connected with said second component inlet, said second annular nozzle having a nozzle orifice defined by said housing and a second adjustable member movably mounted relative to said housing, and said second annular nozzle being directed toward said circular mixing zone;

a third annular nozzle in said housing fluidly connected with said second component inlet, said third annular nozzle having a nozzle orifice defined by said housing and a third adjustable member movably mounted relative to said housing, and said third annular nozzle being directed toward said circular mixing zone;

wherein said second annular nozzle is directed radially inwardly and said third annular nozzle is concentric with said second annular nozzle and directed radially outwardly at a position opposite to said second annular nozzle.

11. The static mixing head of claim 10, wherein said mixing head housing has a longitudinal axis, said first component inlet is substantially axial, and said second component inlet is substantially radial.

12. The static mixing head of claim 10, wherein first and second displacement mechanisms are connected with said first and second adjustable members, respectively.

13. The static mixing head of claim 12, wherein said mixing head housing has a longitudinal axis, said first component inlet is substantially axial, said second component inlet is substantially radial, and each of said nozzle orifices is directed toward said circular mixing zone in a different downward direction.

14. The static mixing head of claim 12, wherein said third adjustable member is rigidly connected with said second adjustable member for adjustment of said third adjustable member together with said second displacement mechanism.

15. The static mixing head of claim 14, wherein said second and third adjustable members are rigidly connected together by a plurality of ribs extending below said circular mixing zone.

16. The static mixing head of claim 15, wherein said ribs define fluid passages therein fluidly connecting said third annular nozzle with said second component inlet.

17. The static mixing head of claim 10, wherein each of said adjustable members are connected to said mixing head housing by screw threads.

* * * * *